US009067719B2

(12) United States Patent
Fukui

(10) Patent No.: US 9,067,719 B2
(45) Date of Patent: Jun. 30, 2015

(54) CONTAINER

(75) Inventor: Atsuko Fukui, Chiyoda-ku (JP)

(73) Assignee: RYUKAKUSAN CO., LTD., Tokyo (JP)

( * ) Notice: Subject to any disclaimer, the term of this patent is extended or adjusted under 35 U.S.C. 154(b) by 238 days.

(21) Appl. No.: 13/129,506

(22) PCT Filed: Nov. 19, 2008

(86) PCT No.: PCT/JP2008/071025
§ 371 (c)(1),
(2), (4) Date: May 16, 2011

(87) PCT Pub. No.: WO2010/058456
PCT Pub. Date: May 27, 2010

(65) Prior Publication Data

US 2011/0226139 A1 Sep. 22, 2011

(51) Int. Cl.

| | |
|---|---|
| ***A23G 1/10*** | (2006.01) |
| ***B65D 75/58*** | (2006.01) |
| ***B65B 9/12*** | (2006.01) |
| ***B65B 51/30*** | (2006.01) |
| *B65D 85/72* | (2006.01) |

(52) U.S. Cl.
CPC ..... *B65D 75/5811* (2013.01); *B65B 9/12* (2013.01); *B65B 51/306* (2013.01); *B65D 85/72* (2013.01)

(58) Field of Classification Search
USPC ..... 99/485, 295; 604/27, 57, 59, 60, 62, 68, 604/71, 73, 131
See application file for complete search history.

(56) References Cited

U.S. PATENT DOCUMENTS 4,974,732 A * 12/1990 Sullivan et al. ..... 222/541.6

FOREIGN PATENT DOCUMENTS

| | | | |
|---|---|---|---|
| AU | 2001-1415601 | A | 5/2001 |
| JP | 49-062296 | A | 6/1974 |
| JP | 06-056187 | A | 3/1994 |
| JP | 3026353 | U | 7/1996 |
| JP | 08-282681 | A | 10/1996 |
| JP | 11-171241 | A | 6/1999 |
| JP | 4190185 | * | 5/2001 |

(Continued)

OTHER PUBLICATIONS

English language translation of JP3026353.*

(Continued)

*Primary Examiner* — Dana Ross
*Assistant Examiner* — Joseph Iskra
(74) *Attorney, Agent, or Firm* — Sughrue Mion, PLLC

(57) ABSTRACT

An edible gelatinized material that fills a container is enabled to be extruded being crushed into grains each having a proper size such that a patient, a child, or an elderly person who has difficulty in swallowing a medicine, etc., using ordinary drinking water, etc., for administration of the medicine, etc., is enabled to easily execute the administration, by facilitating the swallowing of the medicine, etc., without causing such a person any difficulty, feeling of a foreign substance, etc.
As a solution for the above, according to the present invention, a container A1 provided with an extruding unit 20 to externally extrude an edible gelatinized material internally filling and accommodated is characterized in that crushing units 20*e* and 20*e* are provided in the vicinity of the extruding unit 20, that crush the edible gelatinized material extruded from the extruding unit 20 associated with the extruding operation of the extruding unit 20 into grains each having a size that enables easy swallowing of the grain.

7 Claims, 6 Drawing Sheets

(56) References Cited

FOREIGN PATENT DOCUMENTS

| | | | | |
|---|---|---|---|---|
| JP | 2003-095289 | A | | 4/2003 |
| WO | 01/36294 | A1 | | 5/2001 |
| WO | WO 2009000946 | | * | 12/2008 |

OTHER PUBLICATIONS

English language translation of JP3026353; Ninomiya, Horoshi; Jul. 12, 1996.*

* cited by examiner

CONTAINER

CROSS REFERENCE TO RELATED APPLICATIONS

This application is a National Stage of International Application No. PCT/JP2008/071025 filed Nov. 19, 2008, the contents of all of which are incorporated herein by reference in their entirety.

TECHNICAL FIELD

The present invention relates to a container that is filled with an edible gelatinized material such as a beverage that assists swallowing.

BACKGROUND ART

Conventionally, oral administration of a medicine is generally executed with water or plain hot water. However, with such water or plain hot water, oral administration of a medicine is difficult for a person who has difficulty in swallowing such as especially an elderly person. When the person orally takes a medicine that has a medicine form such as a powder medicine, a granule medicine, a capsule, or a pill, the person can not fully swallow the medicine and, instead, is choked or the medicine stays inside the oral cavity. Therefore, not only no sufficient therapeutic effect can be acquired but also the patient him/herself, etc., may feel uncomfortable.

Therefore, a medicine such as a pill or a capsule is crushed or a medicine is mixed with food such as, for example, rice, fermented-soybean-paste soup, or juice when the medicine is administered to a person. However, each of these procedures needs many steps and takes a longtime and, in addition, involves risks for the life of the person when the person has a disorder in swallowing.

Furthermore, the medical effect first expected may not be acquired because an adjustment of the time to release the medicine ingredients, masking of the taste, etc., are obstructed due to the crushing of the pill or the capsule.

To solve the above problem, a container is present that is disclosed in Patent Document 1. FIG. 6 is a front view of the main portion of the container, that accompanies Patent Document 1.

The conventional container described in Patent Document 1 is a container that is formed by: causing edges on both sides in the longitudinal direction of a sheet material to face each other to be adjacent to each other; forming a tubular body by joining the edges on both sides in the longitudinal direction; sealing in the transverse direction an opening on one end of the tubular body; filling the inside of the tubular body with an item to be accommodated therein from an opening on the other end of the tubular body; hermetically sealing the tubular body by sealing in the transverse direction the opening on the other end of the tubular body such that a layer of the item to be accommodated therein and a gas layer are formed in the inside of the tubular body; pressing again in the transverse direction the sealed portion of the opening on the one end and the vicinity thereof to seal the portion and the vicinity; thereby, reducing the inner volume of the tubular body and inflating the tubular body to form the tubular body into a circular column shape; and dividing the tubular body into individual containers by cutting the portion that is sealed in the transverse direction. Patent Document 1: Japanese Laid-Open Patent Publication No. 11-171241

DISCLOSURE OF THE INVENTION

Problem that the Invention is to Solve

In the Patent document 1, FIG. 6 thereof depicts a triangle cutout that is denoted by a reference numeral "3" in the vicinity of a corner of a container 1 with the schematic description that a bag opening notch 3 is formed at a predetermined position of a longitudinal sealed portion 2 of the container 1.

However, an opening for unsealing not depicted that is formed by cutting out from the bag opening notch 3 schematically described in Patent Document 1 has an irregular shape depending on the level of the force for the cutting out.

When an edible gelatinized material such as a beverage that assists swallowing is extruded from such an opening for unsealing, a filling that has a continuous cross section having a substantially same shape as that of the opening for unsealing having the irregular shape is formed in a shape like, so to speak, thin-strip gelidium jelly. Therefore, the filling is also extruded being not crushed into grains.

In such a case: the filler needs to be crushed in advance using a spoon, chopsticks, etc., to be crushed into grains each having a proper size; it is difficult for an elderly person, a child, etc., to take such a labor; and the labor itself is troublesome and takes a long time.

The object of the present invention is to provide a container that enables an edible gelatinized material that fills up the container to be extruded being crushed into grains each having a proper size such that a patient, a child, or an elderly person who has difficulty in swallowing a medicine, etc., using ordinary drinking water, etc., for administration of the medicine, etc., can easily execute the administration, by facilitating the swallowing of the medicine, etc., without causing such a person any difficulty, feeling of a foreign substance, etc.

Means to Solve the Problem

The configuration of the present invention to achieve the objective is as follows.

A container of claim 1 is formed with an extruding unit to externally extrude an edible gelatinized material that fills up the container and that is accommodated therein, characterized in that a crushing unit is formed in the vicinity of the extruding unit, that crushes the edible gelatinized material extruded from the extruding unit associated with the extruding operation of the extruding unit into grains each having a size with which the grain can easily be swallowed.

A container of claim 2 is characterized in that the crushing unit of claim 1 is provided on each side of a base end opening of the extruding unit.

A container of claim 3 is formed with a filled-up unit that is filled with and accommodates the edible gelatinized material, and is formed with the extruding unit whose opening has a width that gradually is narrowed from the base end opening facing the filled-up unit toward the top end opening, in the configuration described in claim 1 or 2.

A container of claim 4 is formed with the extruding unit described in any one of claims 1 to 3 that is shifted from the central axis line in the width direction.

Effect of the Invention

According to the invention described in claim 1, the crushing unit that is formed in the vicinity of the extruding unit can crush the edible gelatinized material extruded from the extruding unit associated with the extruding operation of the extruding unit into grains each having a size with which the gain can easily be swallowed.

According to the invention described in claim 2, the crushing units are provided on both sides of the base end opening of the extruding unit and, therefore, crushing of the edible gelatinized material can efficiently be executed.

According to the invention described in claim 3, the extruding unit is formed whose opening has a width that gradually is narrowed from the base end opening toward the top end opening and, therefore, the edible gelatinized material that is crushed by the crushing unit can again be crushed.

According to the invention described in claim 4, the extruding unit is formed being shifted from the central axis line in the width direction and, therefore, the edible gelatinized material can easily be extruded.

EXPLANATIONS OF LETTERS OR NUMERALS

20, 22 extruding unit
20*a* base end opening
20*d*, 22*b* top end opening
20*e* crushing unit
A1 to A4 container
P edible gelatinized material

BEST MODES FOR CARRYING OUT THE INVENTION

Figure 1:
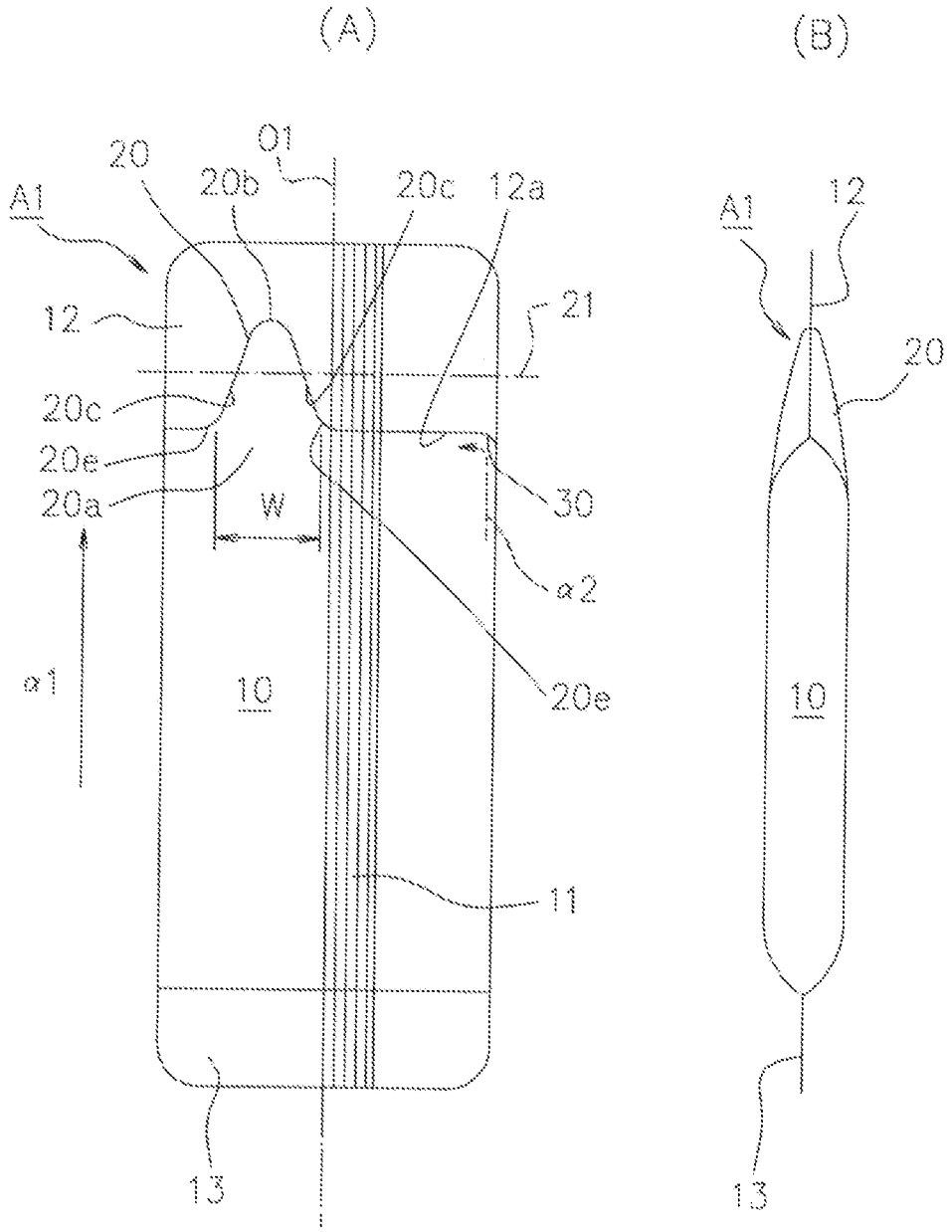
FIG. 1(A) is a front view of a container according to a first embodiment of the present invention, and (B) is a side view thereof.
Figure 2:
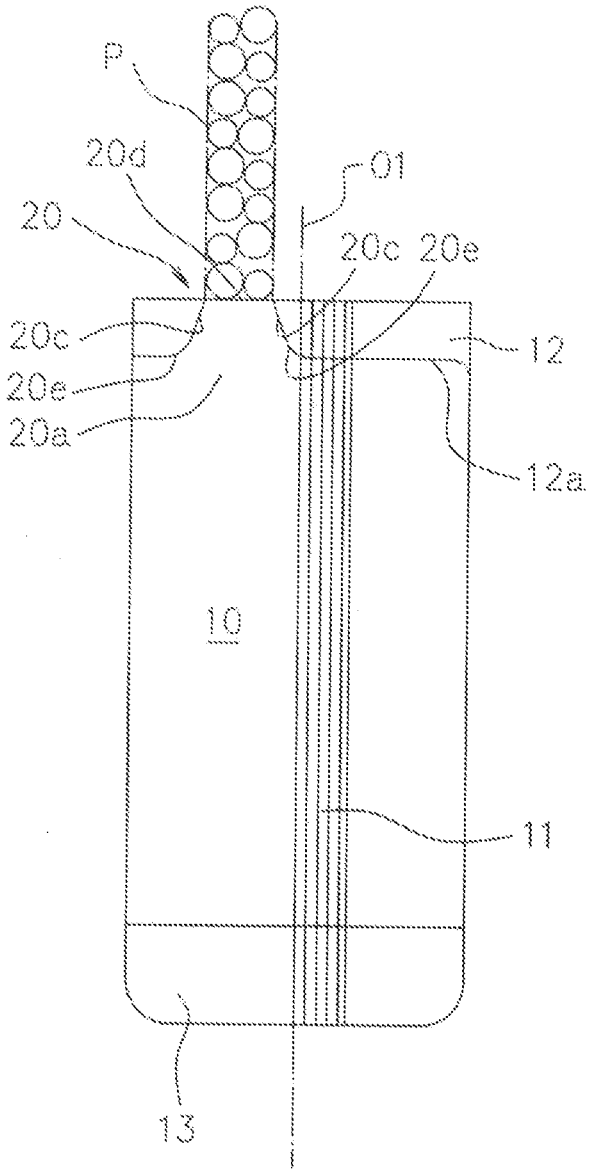
FIG. 2 is a plan view of the state where an extruding unit is formed in a lateral sealed portion by removing a portion of the lateral sealed portion using a clipping line as a border.

The best modes for carrying out the present invention will be described with reference to the accompanying drawings. FIG. 1 (A) is a front view of a container according to a first embodiment of the present invention, and (B) is a side view thereof. FIG. 2 is a plan view of the state where an extruding unit is formed in a lateral sealed portion by removing a portion of the lateral sealed portion using a clipping line as a border.

A container A1 according to the first embodiment of the present invention is a container that has an elongated stick shape and that is formed by forming a filled-up unit 10 that has a capacity capable of being filled with an edible gelatinized material of a predetermined amount, into a partition having a rectangular shape as its frontal appearance and by hermetically sealing the filled-up unit 10. The container A1 has a structure as follows in the embodiment.

The "edible gelatinized material" includes: a paste material such as agar or carageenan; mannitol; etc., and is a low-calorie non-sugar swallowing-assisting beverage that has a predetermined jelly strength.

In the container A1, the filled-up unit 10 is formed into a partition by thermally welding edges on both sides in the longitudinal direction of a rectangular packaging material with each other for a constant width to form a tubular shape and by thermally welding both ends of the packaging material formed into the tubular shape each for a predetermined width.

A portion that is formed by thermally welding the edges on both sides and that has the constant width is referred to as "longitudinal sealed portion 11" and portions that are formed by thermally welding both ends each for the predetermined width are referred to as "lateral sealed portions 12 and 13".

In a side portion that is an inner edge 12*a* of the lateral sealed portion 12 partitioning the filled-up unit 10 and that is away from an extruding unit 20 described later, a flowing unit 30 is provided that is configured by a required curve and that causes the edible gelatinized material to flow toward the extruding unit 20 by pushing the filled-up unit 10.

The "required curve" may be a curve such as, for example, an arc as depicted that can cause the edible gelatinized material to flow toward the extruding unit 20.

In other words, the flowing unit 30 functions to cause the edible gelatinized material that is caused to flow by a pushing operation in a direction $\alpha 1$ that is perpendicular to the lateral sealed portion 12, to flow toward the extruding unit 20 along the inner edge 12*a* as indicated by an arrow $\alpha 2$. Thereby, the amount of the edible gelatinized material that remains in the filled-up unit 10 can be reduced.

As depicted in FIG. 1(A), the longitudinal sealed portion 11 is formed at a position that coincides with a central axis line O1 of the container A1, and is folded in either one direction.

The lateral sealed portion 12 is formed to have a wider width than that of the lateral sealed portion 13 and the extruding unit 20 is formed into a partition being shifted toward one of the sides that sandwiches the central axis line O1.

The extruding unit 20 is formed into the partition by not welding a portion of the lateral sealed portion 12, and has a trapezoidal shape having the width W of its opening that gradually is narrowed from a base end opening 20*a* facing the filled-up unit 10 toward a top end 20*b*.

Edges 20*c* and 20*c* that partition the extruding unit 20 are formed such that the interval therebetween is gradually narrowed from the base end opening 20*a* toward the top end 20*b*.

In other words, the edges 20*c* and 20*c* are formed to cross at an acute angle the inner edge 12*a* of the lateral sealed portion 12 that partitions the extruding unit 10.

The lateral sealed portion 12 is formed with a clipping line 21 that crosses the central axis line O1 at a right angle and that is at a position to cross a portion that is shifted to the base end opening 20*a* from the extruding unit 20.

By removing a portion of the lateral sealed portion 12 using the clipping line 21, a top end opening (hereinafter, "opening for unsealing") 20*d* as depicted in FIG. 2 is formed in the lateral sealed portion 12.

Thereby, crossing portions 20*e* and 20*e* of the inner edge 12*a* and the edges 20*c* and 20*c* function as crushing units that crush the edible gelatinized material extruded from the extruding unit 20 associated with the extruding operation of the extruding unit 20 into grains each having a size that can easily be swallowed.

The edges 20*c* and 20*c* are formed such that the interval therebetween is gradually narrowed from the base end opening 20*a* toward the opening for unsealing 20*d*, in other words, the width of the opening gradually becomes smaller from the base end opening 20*a* toward the top end 20*b*. Therefore, the edible gelatinized material that has been crushed in the crossing portions 20*e* and 20*e* that are the crushing units can again be crushed. The edible gelatinized material is denoted by "P" in FIG. 2.

A manufacturing method of the container A1 will be described with reference to FIGS. 3(A) and (B). FIG. 3(A) is an explanatory diagram of the purview of a manufacturing process of the container A1, and (B) is an explanatory diagram of the purview of a manufacturing apparatus.

In the purview 40 of the manufacturing apparatus, components are sequentially disposed at necessary intervals from the upstream side toward the downstream side in a conveyance direction α3 of the packaging material having a belt shape, that are a filling nozzle 43 for the edible gelatinized material, a pair of longitudinal sealing rolls 41 and 41 (one of these not depicted), folding rolls 42 and 42 for folding the longitudinal sealed portion 11, a pair of first lateral sealing rolls 44 and 44, a pair of second lateral sealing rolls 45 and 45, and a rotating blade 46. These components are adapted to be driven and rotated by a driving source not depicted being synchronized with each other.

The longitudinal sealing rolls 41 and 41 convey the packaging material in the conveyance direction α3, and form the packaging material into the tubular shape by thermally welding the edges on both sides in the longitudinal direction (conveyance direction) of the packaging material with each other for a constant width to form the tubular shape.

The first lateral sealing rolls 44 and 44 thermally weld portions that become the lateral sealed portions 12 and 13 that are adjacent to each other of the packaging material formed into the tubular shape. A portion that corresponds to the extruding unit 20 is a recess not depicted that has the same shape and, therefore, is adapted not to be welded.

The second lateral sealing rolls 45 and 45 again press and seal the lateral sealed portions 12 and 13 that are formed by the thermal welding.

Figure 3:
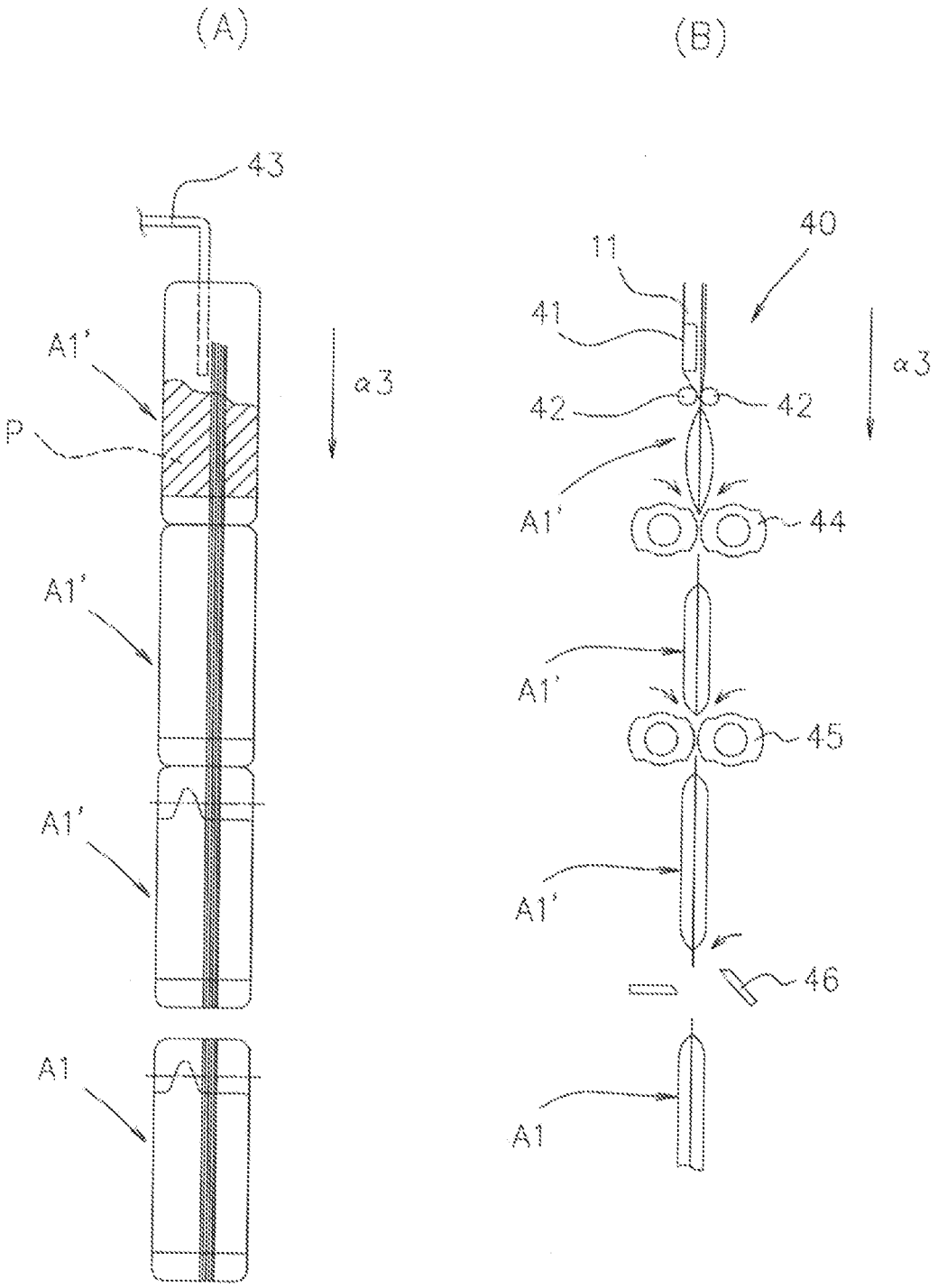
FIG. 3(A) is an explanatory diagram of the purview of a manufacturing process of the container, and (B) is an explanatory diagram of the purview of a manufacturing apparatus.

The rotating blade 46 cuts out and separates individual containers A1 and A1 from each other at the border between the lateral sealed portions 12 and 13. In FIG. 3, "A1'" denotes the container that is not individually separated.

The manufacturing process will be described.

The packaging material that is supplied onto the top of the manufacturing apparatus by a conveying step not depicted is conveyed in the conveyance direction α3 being held and sandwiched by the longitudinal sealing rolls 41 and 41 that are heated.

In the above, the edges on both sides of the packaging material are thermally welded by the longitudinal sealing rolls 41 and 41 for the full length thereof in the longitudinal direction and, thereby, a tubular shape is formed with the longitudinal sealed portion 11 being formed. The longitudinal sealed portion 11 is folded by the folding rolls 42 and 42.

After the packaging material is formed into the tubular shape, the sealed portions 12 and 13 that are adjacent to each other as the head and the tail of the containers and that are on the lower side of the packaging material are thermally welded by the lateral sealing rolls 44 and 44 that are driven and rotated being synchronized with the conveyance speed. Thereafter, the tubular-shaped packaging material is filled with the edible gelatinized material P from the nozzle 43.

After the tubular packaging material is filled with the edible gelatinized material P, the packaging material is further conveyed downstream and, in turn, the sealed portions 12 and 13 at the ends on the upper side of the container A1 are again pressed and sealed by the lateral sealing rolls 45 and 45 and, thereafter, is cut out by the rotating blade 44 at the border of the sealed portions 12 and 13 adjacent to each other as the head and the tail of the container. Thereby, the individual container A1 is cut out and formed.

When the container A1 is used, the opening for unsealing 20*d* is formed as depicted in FIG. 2 when a portion of the thermally sealed portion 12 is removed using the clipping line 21 as the border.

At this time, splashing of the edible gelatinized material can be prevented by removing the portion of the thermally sealed portion 12 holding tightly a portion that is located on the side of the base end opening of the clipping line 21 of the extruding unit 20.

When the filled-up unit 10 is pressed, the edible gelatinized material that is accommodated in the filled-up unit 10 is crushed by the crossing portions 20*c* and 20*c* of the extruding unit 20 associated with the extruding operation of the extruding unit 20 into grains each having the size with which the grain can easily be swallowed and, thereafter, flows into the extruding unit 20.

The edible gelatinized material having flowed into the extruding unit 20 is again crushed by the extruding unit 20 whose opening is formed to have the width that gradually becomes smaller from the base end opening 20*a* toward the opening for unsealing 20*d*.

Thereby, the edible gelatinized material with which the container is filled can be extruded being crushed into grains each having a proper size such that a patient, a child, or an elderly person who has difficulty in swallowing a medicine, etc., using ordinary drinking water, etc., for administration of the medicine, etc., can easily execute the administration, by facilitating the swallowing of the medicine, etc., without causing such a person any difficulty, feeling of a foreign substance, etc.

Figure 4:
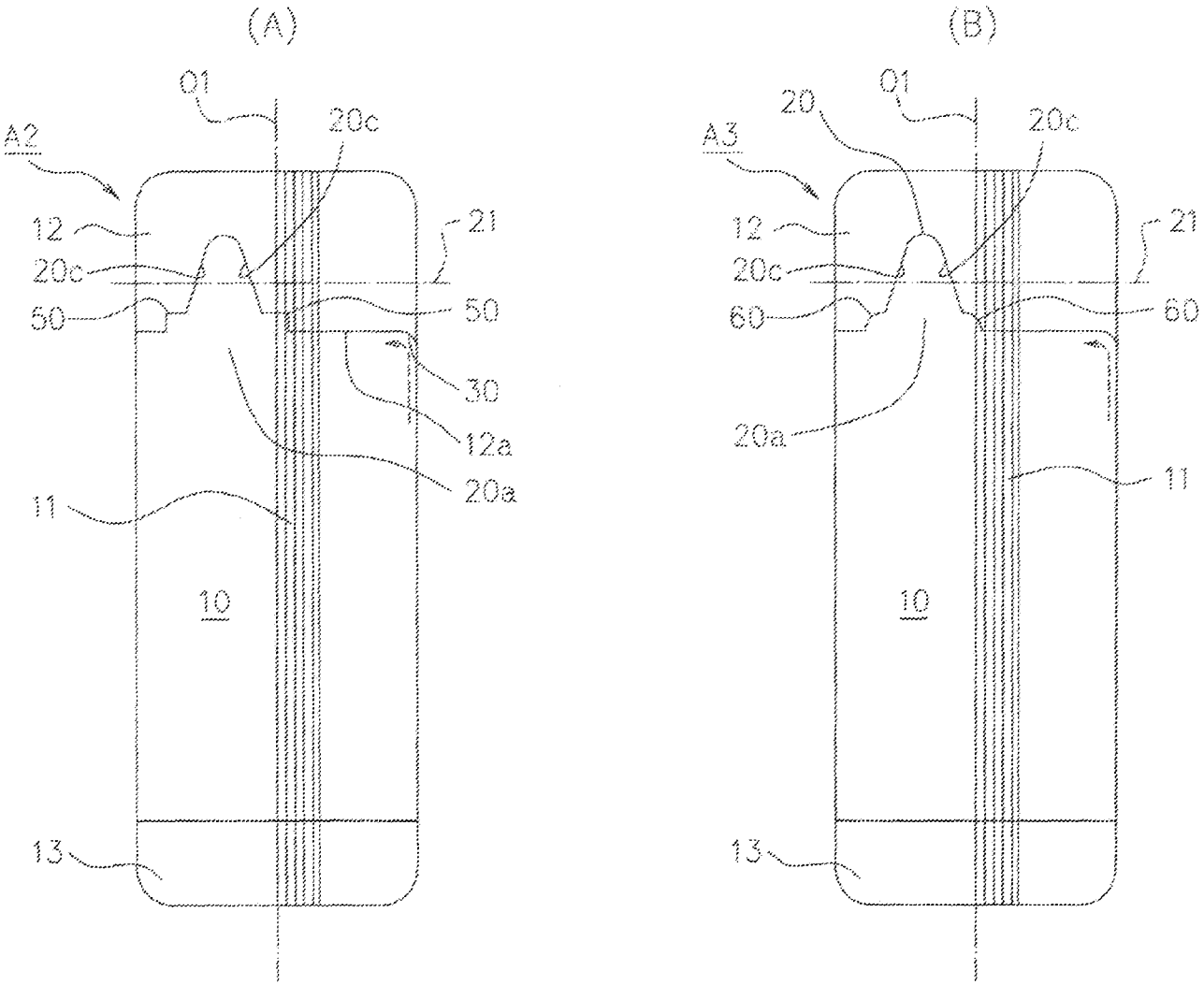
FIG. 4(A) is a front view of a container according to a second embodiment, and (B) is a front view of a container according to a third embodiment.
Figure 5:
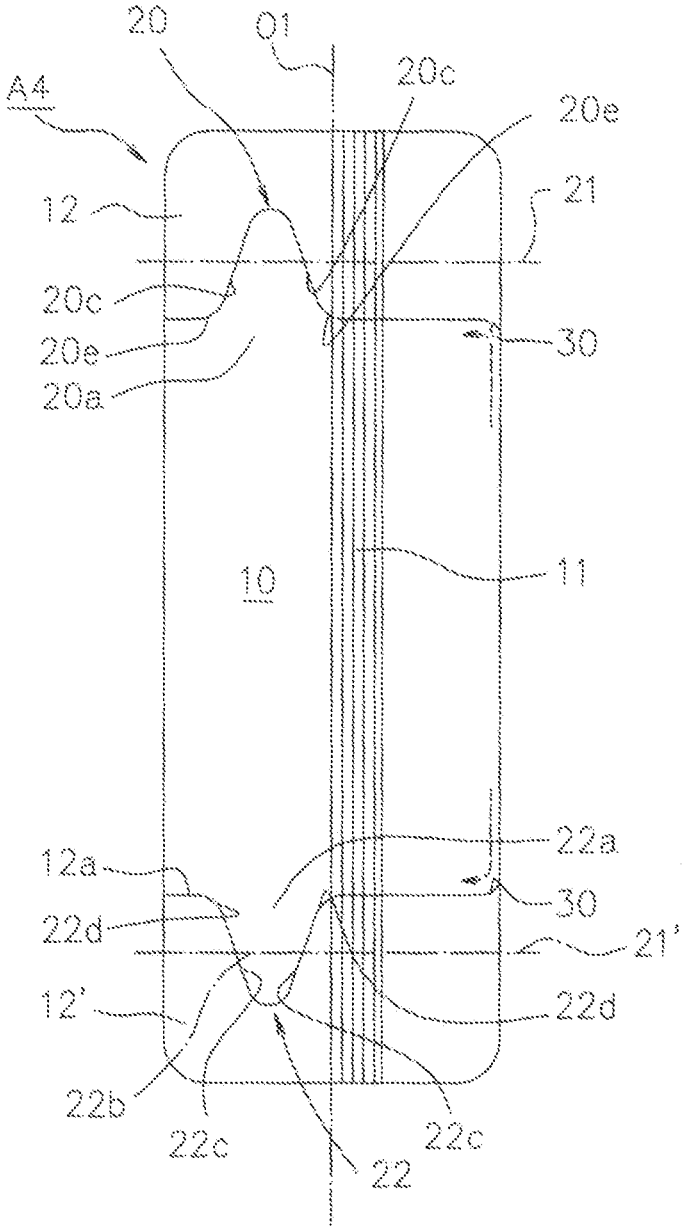
FIG. 5 is a front view of a container according to a fourth embodiment.
Figure 6:
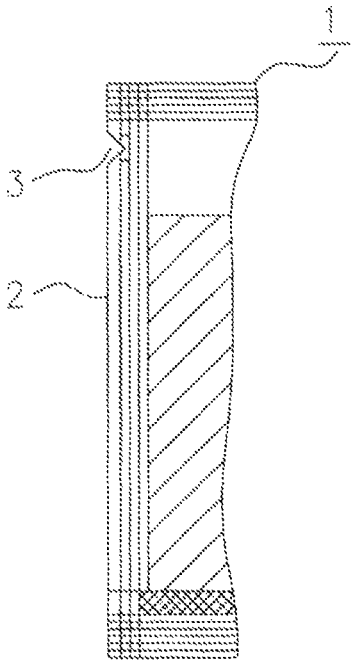
FIG. 6 is a front view of a main portion of a container that accompanies Patent Document 1.

Containers according to a second to a fourth embodiment will be described with reference to FIGS. 4(A), (B), and 5. FIG. 4(A) is a front view of the container according to the second embodiment, and (B) is a front view of the container according to the third embodiment. FIG. 5 is a front view of the container according to the fourth embodiment. Components that are similar to those described in the above embodiment will be given the same reference numerals and will not again be described.

The container A2 according to the second embodiment is disposed with crushing units that each have a different configuration from the above.

The crushing units 50 and 50 are formed as recesses each having a V shape on both sides of the base end opening 20*a* of the extruding unit 20. Due to this configuration, it can be considered that the edible gelatinized material can more efficiently be crushed.

The container A3 according to the third embodiment is disposed with crushing units that each have a different configuration from the above.

The crushing units 60 and 60 are formed as recesses each having an arc shape on both sides of the base end opening 20*a* of the extruding unit 20. Due to this configuration, it can be considered that the edible gelatinized material can more efficiently be crushed.

As depicted in FIG. 5, the container A4 according to the fourth embodiment is formed with the extruding units 20 and 22 in lateral sealed portions 12 and 12' each being shifted from the central axis line O1 in the width direction.

The extruding unit 22 has the same configuration as that of the extruding unit 20 in that the width of its opening gradually becomes smaller from the base end opening 22*a* to the top end opening 22*b*. However, the rate for the width of the opening to become smaller is different. "22*c*" denotes an edge. "22*d*" denotes a crushing unit that is similar to the crushing unit 20*e*. "21" denotes a clipping line.

According to this embodiment, because the extruding units 20 and 22 each having a different form from each other are provided, the edible gelatinized material can be crushed into grains of the two kinds each having a different grain size from each other and, therefore, for example, the crushing state for an adult or the crushing state for a child can arbitrarily be selected.

The present invention is not limited to the embodiments and modifications as follows can be implemented. Though the examples of the crushing units that are formed on both sides of the base end opening of the extruding unit have been described in the embodiments, the crushing unit may be formed on either one side of the base end opening.

The extruding unit has been described in the embodiments taking the example of the extruding unit that is formed to have the width of its opening becoming smaller from the base end opening facing the filled-up unit toward the top end opening. However, the width of the opening may be constant from the base end opening toward the top end opening, or the width of the opening may be formed such that the width gradually becomes larger from the base end opening toward the top end opening.

The invention claimed is:

1. A container that is provided with a single extruding unit to externally extrude an edible gelatinized material internally filling up and accommodated, wherein the container has an elongated stick shape and is formed by forming a filled-up unit that has a capacity being filled with the edible gelatinized material of a predetermined amount, into a partition having a rectangular shape as its frontal appearance and by hermetically sealing the filled-up unit, the filled-up unit is formed into a partition by thermally welding edges on both sides in the longitudinal direction of a rectangular packaging material with each other for a constant width to form a tubular shape thus forming a longitudinal sealed portion and by thermally welding both ends of the packaging material formed into the tubular shape each for a predetermined width, thus forming a first lateral sealed portion and a second lateral sealed portion, the longitudinal sealed portion is formed at a position that coincides with a central axis line of the container, and is folded in either one direction, the first lateral sealed portion is formed with a clipping line that crosses the central axis line at a right angle and that is at a position to cross a portion that is shifted to the base end opening from the extruding unit, the single extruding unit is formed into the partition by not welding a portion of the first lateral sealed portion and being shifted from a central axis line of the container in a direction of a width of the container, and a crushing unit is provided in the vicinity of the single extruding unit on at least one side of a base end opening of the single extruding unit, that crushes the edible gelatinized material extruded from the single extruding unit associated with the extruding operation of the single extruding unit into grains each having a size that enables easy swallowing of the grain.

2. The container of claim 1, wherein the crushing unit is provided on each side of the base end opening of the single extruding unit.

3. The container of claim 1, wherein the container is provided with a filled-up unit that is filled with and that accommodates the edible gelatinized material, and wherein the single extruding unit is provided such that a width of an opening thereof gradually becomes smaller from the base end opening facing the filled-up unit toward a top end opening.

4. The container of claim 2, wherein the container is provided with a filled-up unit that is filled with and that accommodates the edible gelatinized material, and wherein the single extruding unit is provided such that a width of an opening thereof gradually becomes smaller from the base end opening facing the filled-up unit toward a top end opening.

5. The container of claim 1, wherein the crushing unit is formed as a recess having a V shape on at least one side of the base end opening of the single extruding unit.

6. The container of claim 1, wherein the crushing unit is formed as a recess having an arc shape on at least one side of the base end opening of the single extruding unit.

7. The container of claim 1, wherein the single extruding unit is formed in the first lateral sealed portion by removing a portion of the first lateral sealed portion using the clipping line as a border.

* * * * *